US007024730B2

(12) United States Patent
Scholes

(10) Patent No.: US 7,024,730 B2
(45) Date of Patent: Apr. 11, 2006

(54) HANDHELD DEVICE FOR HOLDING PLASTIC GROCERY BAGS

(76) Inventor: Jo Ann Putnam Scholes, 20 Fairway Dr., Barrington, RI (US) 02806

( * ) Notice: Subject to any disclaimer, the term of this patent is extended or adjusted under 35 U.S.C. 154(b) by 5 days.

(21) Appl. No.: 10/735,220

(22) Filed: Dec. 12, 2003

(65) Prior Publication Data

US 2004/0123423 A1 Jul. 1, 2004

Related U.S. Application Data

(60) Provisional application No. 60/433,484, filed on Dec. 13, 2002.

(51) Int. Cl.
*A45C 3/04* (2006.01)
*A45F 5/10* (2006.01)

(52) U.S. Cl. ..... 16/422; 16/428; 16/435; 16/110.1; 294/171

(58) Field of Classification Search ..... 16/422, 16/428, 425, 435; 294/170, 171, 149, 156, 294/164; D9/434, 455; 383/6, 15, 25
See application file for complete search history.

(56) References Cited

U.S. PATENT DOCUMENTS

| | | | | | |
|---|---|---|---|---|---|
| 2,215,116 | A | * | 9/1940 | Crary | 294/171 |
| 2,587,329 | A | * | 2/1952 | Jones | 525/417 |
| 4,796,940 | A | * | 1/1989 | Rimland | 294/171 |
| 4,902,060 | A | * | 2/1990 | Nobakht | 294/171 |
| 4,932,702 | A | * | 6/1990 | Sweeny | 294/171 |
| 5,356,190 | A | * | 10/1994 | Torres | 294/171 |
| 5,658,029 | A | * | 8/1997 | Franko | 294/171 |
| 5,775,757 | A | * | 7/1998 | Tipp | 294/171 |
| 5,803,522 | A | * | 9/1998 | Lisbon | 294/171 |
| 6,234,946 | B1 | * | 5/2001 | Fricano | 493/340 |
| 6,354,645 | B1 | * | 3/2002 | Bozlee | 294/171 |
| 6,378,925 | B1 | * | 4/2002 | Greenlee | 294/171 |
| 6,481,771 | B1 | * | 11/2002 | Friedman | 294/171 |

FOREIGN PATENT DOCUMENTS

| | | | | |
|---|---|---|---|---|
| DE | 3528037 | A1 | * | 2/1987 |
| GB | 2202135 | A | * | 9/1988 |
| GB | 2314503 | A | * | 1/1998 |
| JP | 10157744 | A | * | 6/1998 |
| JP | 10215939 | A | * | 8/1998 |
| JP | 10248623 | A | * | 9/1998 |
| JP | 2000109100 | A | * | 4/2000 |

* cited by examiner

*Primary Examiner*—Chuck Y. Mah
(74) *Attorney, Agent, or Firm*—Robert J Doherty

(57) ABSTRACT

A device adapted to be comfortably grasped in the hand of the user to hold the plastic handles of grocery bags.

4 Claims, 9 Drawing Sheets

HANDHELD DEVICE FOR HOLDING PLASTIC GROCERY BAGS

This Application claims the benefit of Provisional Application No. 60/433,484 filed Dec. 13, 2002.

FIELD OF THE INVENTION

This invention relates to a handheld grip for receiving and comfortably holding the integral handles or bails of plastic grocery shopping bags and the like.

BACKGROUND OF THE INVENTION

The commonplace use of plastic grocery bags, that is, the bags available at the supermarket checkout counters which include a container portion for receiving groceries and a pair of hoop-shaped integral upwardly extending flexible handles or bails which the consumer grips in order to carry the merchandise to his or her home or vehicle have also created well recognized attendant concerns. Such concerns include the fact that these relatively narrow strips of plastic that form the integral carrying handles can cut into the holder's hands causing finger numbness or otherwise resultant discomfort when the grocery bags are either heavy or the distance they are carried is relatively long or some combination of both. It is, accordingly, been well recognized that some sort of separate handgrip to receive such handles can provide at least partial relief to the aforementioned problems.

For instance, the following U.S. patents suggest various forms of handgrips to deal with these specific problems: U.S. Pat. No. 4,890,355 issued Jan. 2, 1990 to Schulten; U.S. Pat. No. 4,936,619 issued Jun. 26, 1990 to Salazar; U.S. Pat. No. 4,982,989 issued Jan. 8, 1991 to Sweeny; and U.S. Pat. No. 5,527,076 issued Jun. 18, 1996 to Randels.

While recognizing the problem and offering solutions, there remains a continuing need for a handgrip for plastic bags, which not only prevents the aforementioned hand discomfort but also is easy to grip with one's hand and which avoids assembly or necessarily bulky appendages or accessories.

These and other objects of the present invention are accomplished by the provision of a generally taco-shaped holder of a hand comfortable plastic material having a pair of opposed sidewalls and a thickened base in turn internally provided with a ridged surface to provide a comfortable carrying device for plastic bags and which is of a size and shape to easily conform generally entirely with the user's hand so that the hand grasps and presses on the sidewalls so as to squeeze them together in a comfortable manner.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

DESCRIPTION OF THE PREFERRED EMBODIMENT

Figure 2:
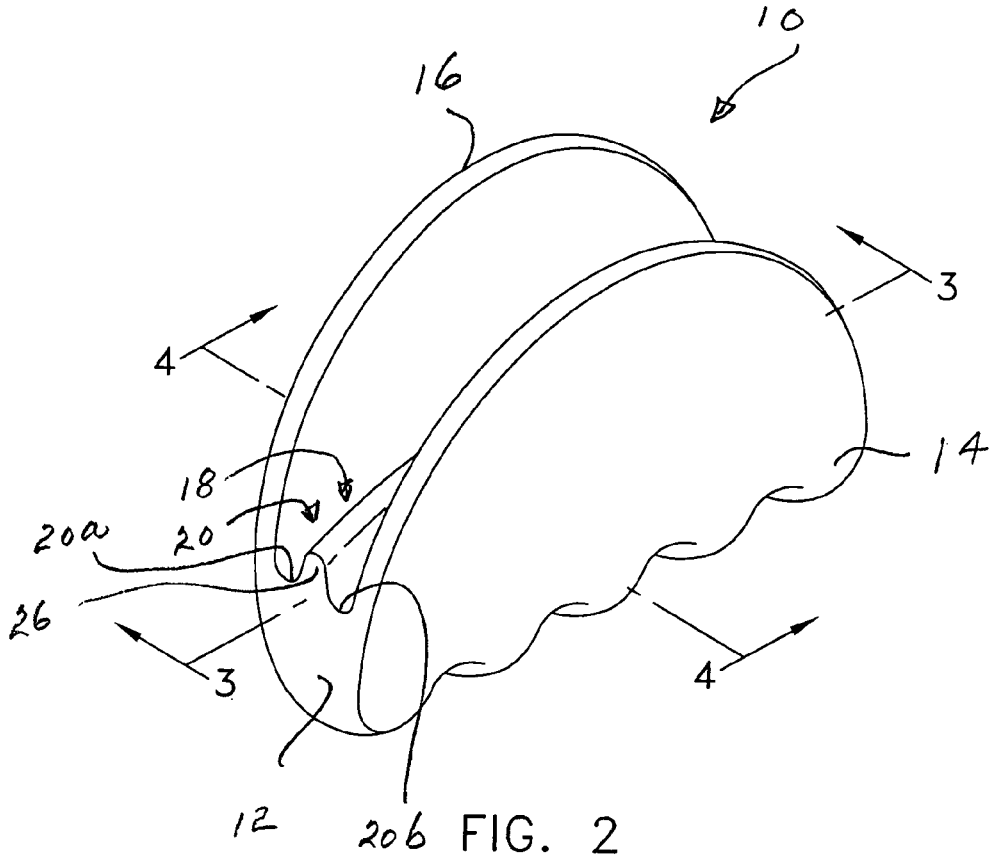
FIG. 2 is a perspective view showing the device of FIG. 1.

Referring now to the drawings and particularly FIG. 2, one form of the device of the present invention is depicted. The device or holder 10 includes a longitudinally extending thickened base portion 12 from which laterally spaced upwardly extending sidewalls 14, 16 extend.

The upper surface 18 of the base 12 and the interior surfaces of the sidewalls 14, 16 cooperatively form a recess 20 for the receipt of the handles or bails 22, 24 of the plastic carrying bag and an upstanding longitudinally oriented ridge 26 that, in effect, separates such recess 20 into separated bail receiving recess portions 20*a* and 20*b*.

The bottom surface of the base 12 is provided with undulations preferably at least four to receive the fingers of one's hand in a comfortable position that further assures non-longitudinal movement of the device 10 vis-à-vis one's hand.

Figure 3:
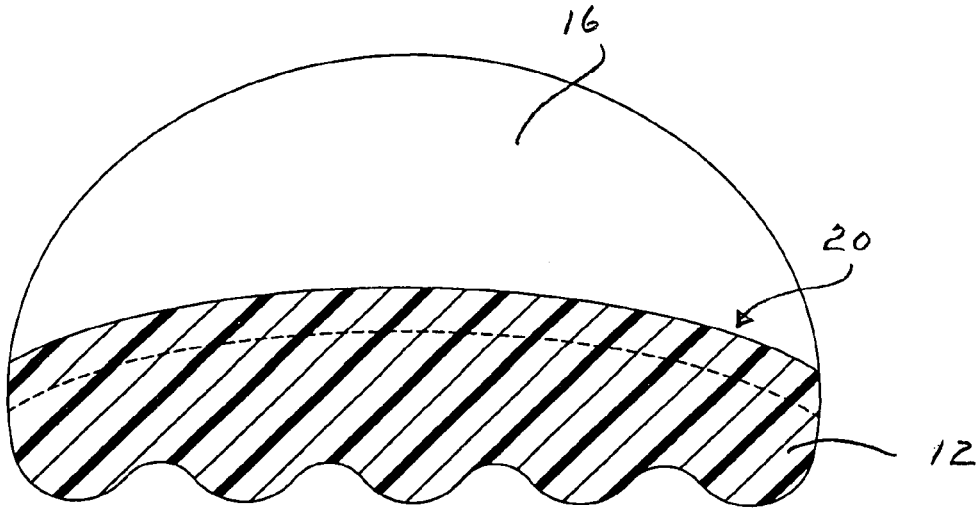
FIG. 3 is a sectional elevational view along the line 3—3 of FIG. 2.
Figure 4:
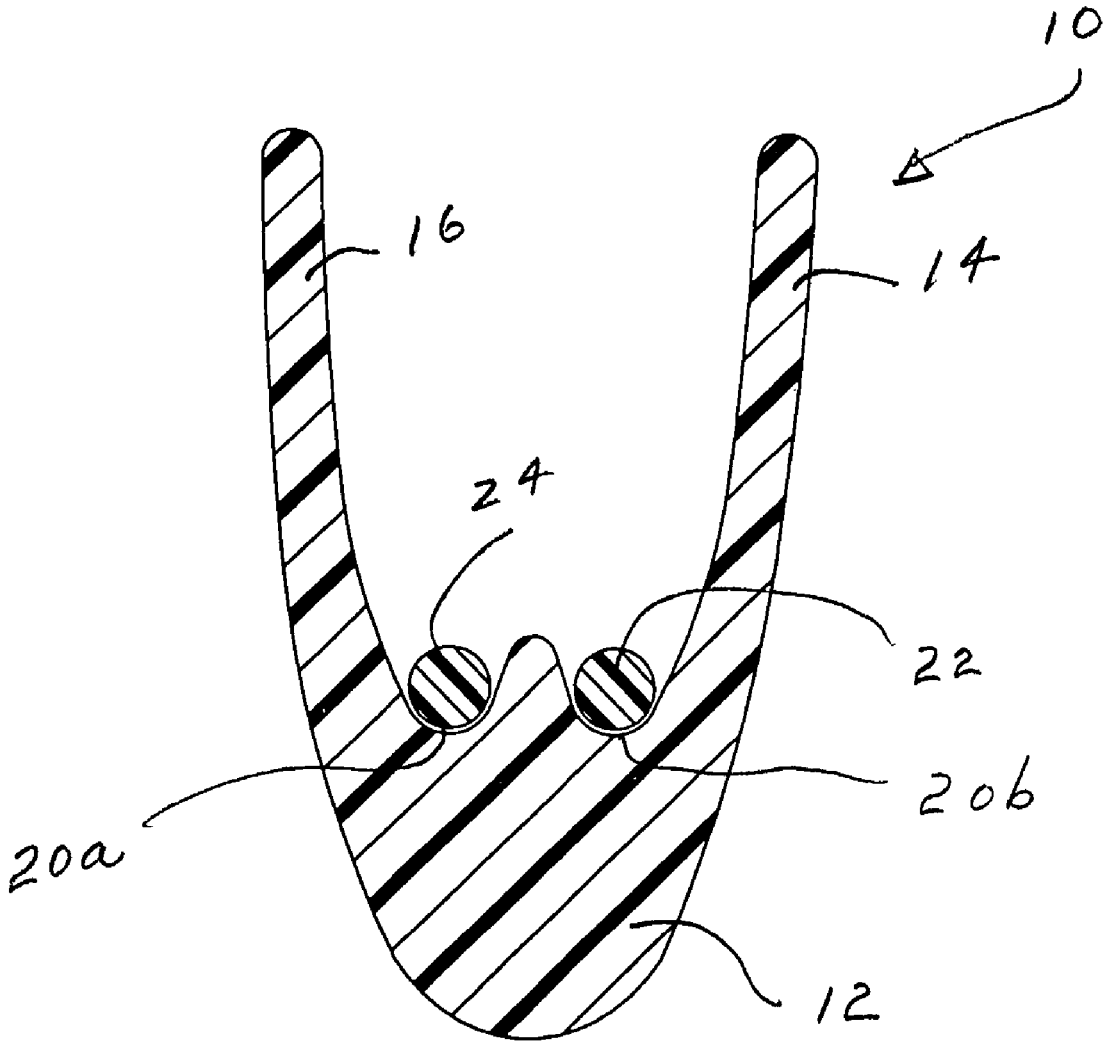
FIG. 4 is a side sectional view along the line 4—4 of FIG. 2 but showing a stylized depiction of the grocery bag handles contained therein.

It should also be brought out that the base 12 is of considerable thickness so that the overall configuration of the device enables the device to be comfortably gripped in a natural gripping action by one's hand. The particular dimensions for average hands would include the following approximate dimensions: length approximately 3½ inches; height approximately 2 inches; width between the sides at the top thereof approximately 1½ inches, and at the base thereof, that is, upper surface of the base, approximately 1 inch; the height of the base approximately ½ inch from the bottom surface thereof to the recess portions 20*a* and 20*b*, and the interior height of the sidewalls from such recess portions 20*a* and 20*b* to the upper longitudinal midpoint thereof approximately 1½ to 1¾ inches. It should be noted that the overall device in a cross-section assumes a generally U-shaped configuration as best shown in FIG. 4. Additionally as best shown in FIGS. 2 and 3, the base recess portions

20*a*, 20*b* are longitudinally arcuately shaped so that the plastic bag handles assume a somewhat curved drape when placed therein.

It should also be indicated that it is important that the device shown in FIGS. 1–5 be constructed from a hand comfortable material of preferably a closed cell resinous plastic foam that is dense, durable, not easily torn and which flexes and compresses enough so that the device forms a comfortable fit within one's hand. It is also desirable that the outer surface of the holder be pebbled so as to exchange a frictional grip on the device by one's hand. A material that meets the above criteria is injection moldable foam or non-foam polyurethane.

The aforementioned suggested dimensions of the device assure one's fingers in a curled grasping position generally do not fully envelope the sides of the device but are retained against one of the sides while the palm compresses the opposite side and the thumb rests comfortably on the top thereof or can additionally compress and/or contact said one side, that is, the side of the device opposite the thumb. In this way then, the device acts more than a pad placed in the bottom of a palm and on which the handles or bails of the plastic bag rests. It has been found that it is tiring for the hand in the grasping motion to take the form of a closed fist. Thus, a more relatively open grasping and subsequently a more comfortable attitude are assumed which enables heavy grocery bags to be carried both comfortably and for a relatively long distances. This desired grasping attitude is shown by the FIG. 1 illustration.

It is also desirable that the material utilized be capable of accepting advertising indicia on the outer surfaces of the sides thereof such that the supermarket passing out these devices as a gift or premium can advertise or others can do likewise. In this regard, the indicia could be placed thereon during the molding process as by embossment or later added by printing techniques.

Figure 1:
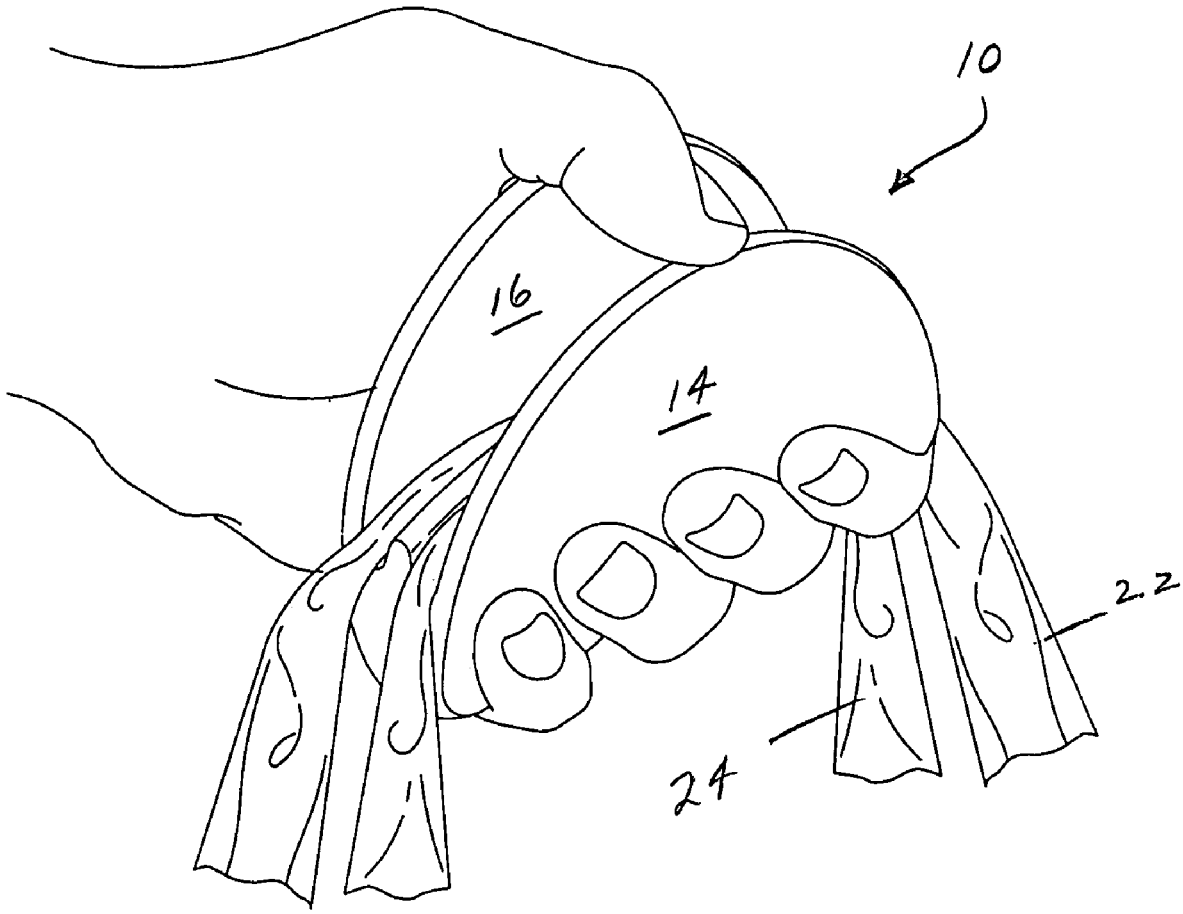
FIG. 1 is a perspective view showing one form of the device of the present invention being grasped so as to support a pair of plastic handles of a grocery bag.

As best shown in FIGS. 1 and 4, the upstanding central ridge of the base provides a separation such that the individual handles 22, 24 of the plastic bag may rest in each of the recess portions 20*a*, 20*b* and thus be separated from each other so that they will not tangle or, if desired, an additional bag or bags can be placed within the recess with the handles 22, 24 of each such bag placed in one of the recess portions 20*a*, 20*b* and in that manner separate the handles from two grocery bags by the same device. Obviously, the person utilizing the device could use two such devices 10 simultaneously to balance the weight distribution of the load.

Turning now to FIGS. 5 through 10 of the drawings, an alternate form of the present invention is depicted. This alternate form is made from a generally circular blank of material that is scored and then upwardly folded to form the opposed sidewalls. Generally, the device 40 is preferably formed from a heavy paperboard or cardboard material that is provided on its lower surface with a finishing layer that can accept printing and the like.

Figure 6:
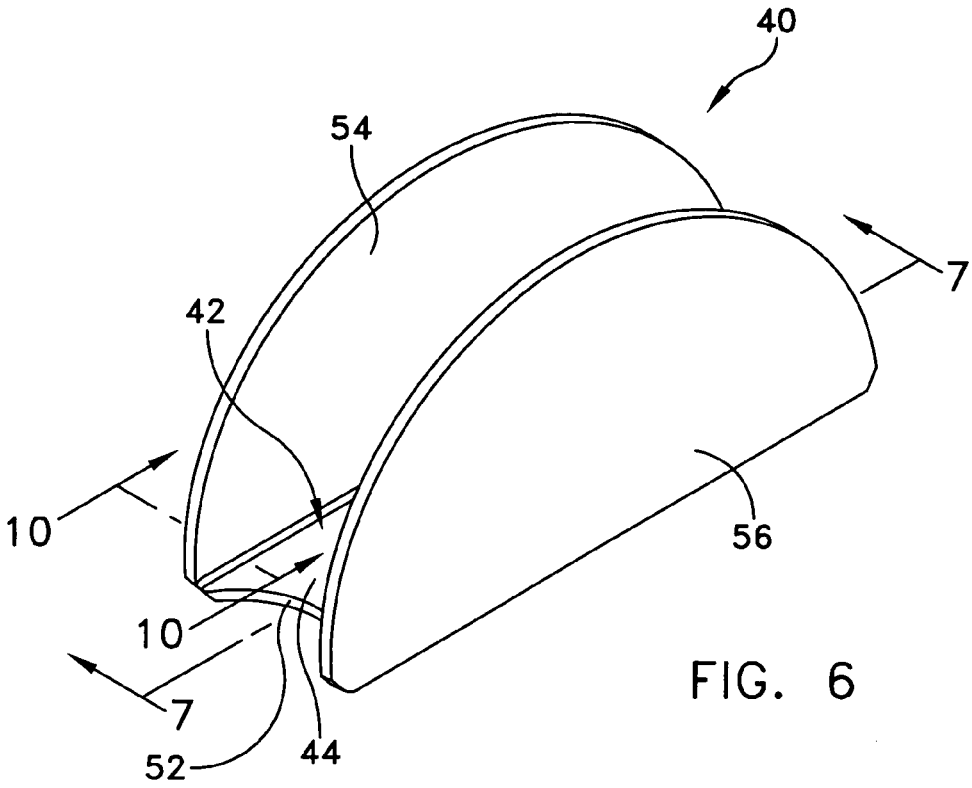
FIG. 6 is a perspective view showing the form of the device illustrated in FIG. 5.
Figure 7:
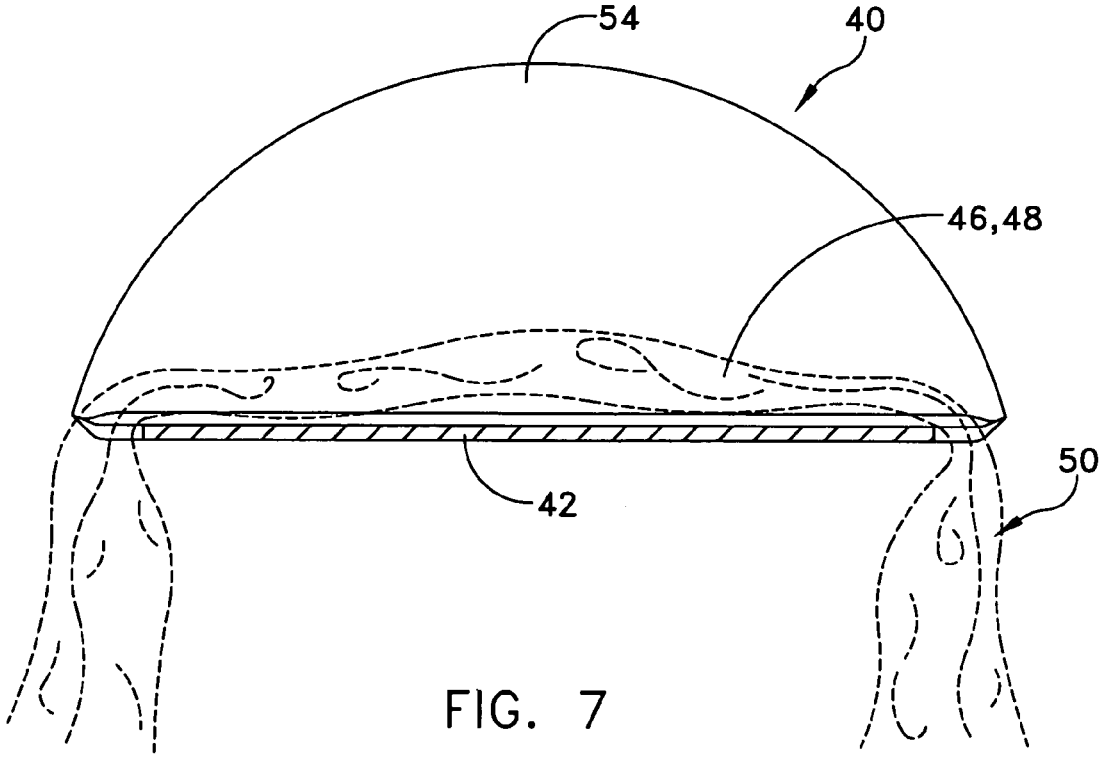
FIG. 7 is a side sectional view along the line 7—7 of FIG. 6.

The best overall view of the article's shape is set forth in FIG. 6 where the overall shape of the device 40 is shown. Therein generally flat base portion 42 longitudinally extends across the width of the device and the upper surface 44 thereof serves as the contact platform for receiving the handles 46, 48 of a plastic bag 50. Each end of the base 42 is inwardly notched so as to provide a recess 52 for the purpose of shortening the longitudinal extent of the base 42 and so that the handles 46, 48 of the bag 50 downwardly extend along a curved surface somewhat inwardly positioned from the edges of the upstanding sidewalls 54 and 56. Such recesses further assure that the bag handles 46, 48 do not slip laterally back and forth along a convex or outwardly rounded surface as would be the case if the ends of the base 42 were not inwardly recessed.

Figure 5:
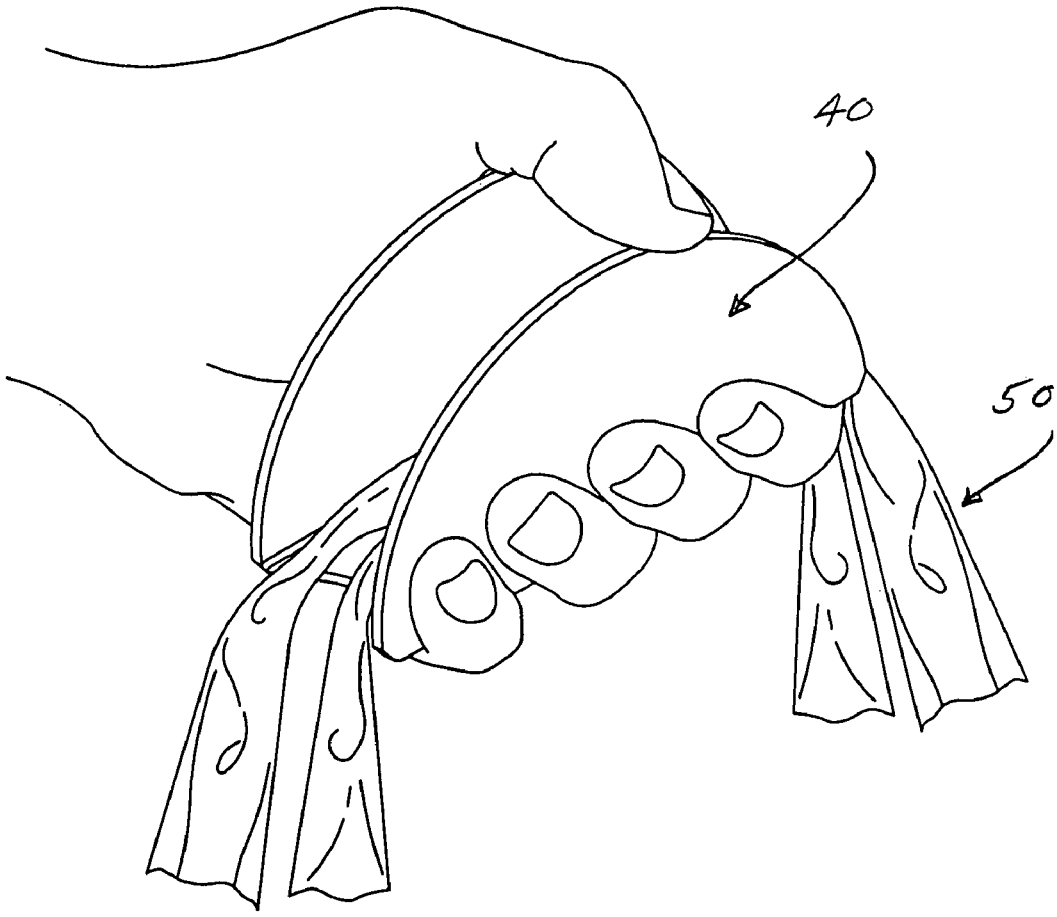
FIG. 5 is a perspective view similar to FIG. 1 but showing another form of the device of the present invention.

The device of FIGS. 5 and 6 is preferably formed from a flat circular blank of paperboard of fiberboard approximately 0.04 to 0.05 inches thick and with a diameter of approximately 4½ inches. The blank is then scored or otherwise reshaped with a punch such that a pair of longitudinally extending chordal recesses 64 are formed in the bottom surface of the blank. Such procedure causes an upward shift or migration of material to form a boss or ridge 66 of migrated material on the upper surface 65 of the blank. This results in a living hinge 70 which enables each of the sidewalls 54, 56 to be upwardly pivoted to a position slightly beyond vertical since further arcuate movement is restricted by the boss or bunch of migrated material 66. This action simulates the desirable squeeze action afforded by the structure of the FIGS. 1–4 embodiment in that the sidewalls 54, 56 tend to spring back into one's hand as the device 40 is manipulated by one's hand in use. Generally, a circular blank is preferred for tooling as well as for use distribution; however, the defining edges of the sidewalls could be truncated or assume other shapes.

Figure 11:
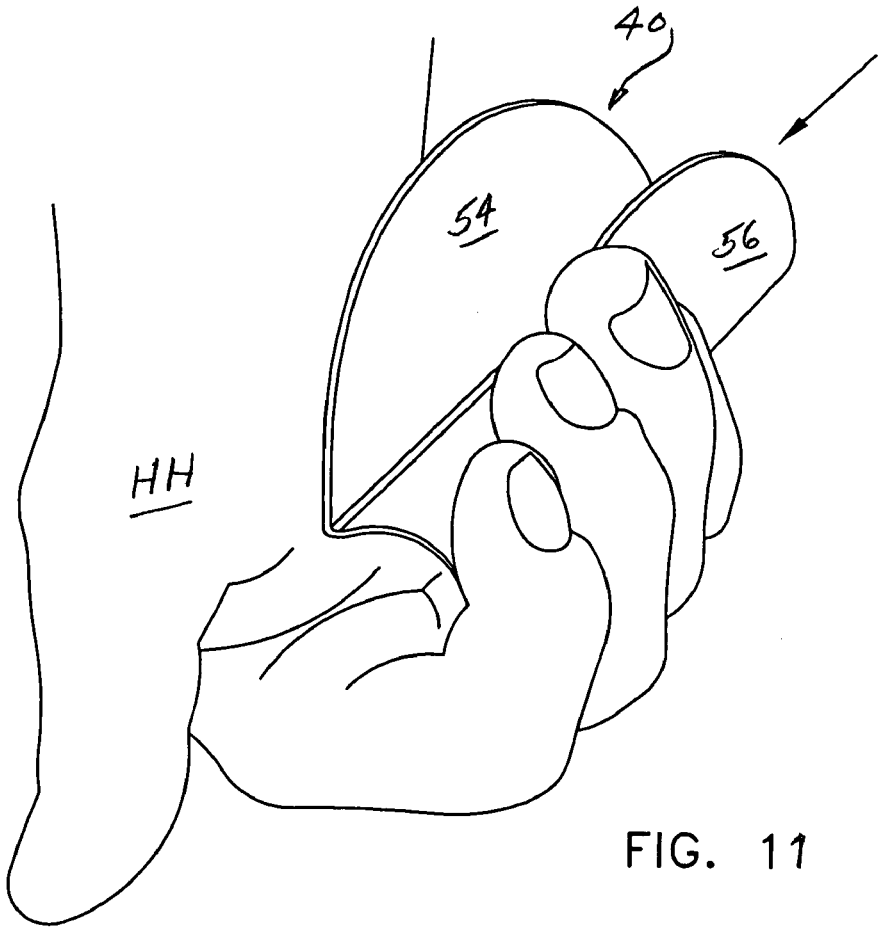
FIG. 11 is a perspective view showing how the holder 42 may be received in the generally U-shaped area of a human palm when upwardly cupped.

When the holder is folded to its use position, it becomes apparent that the holder assumes a generally unshaped cross-sectional configuration that fits the similarly shaped opening of the human hand when the palm is upwardly cupped as shown in FIG. 11. Normally, the holder would not be inserted longitudinally into the palm opening as illustrated by the transition between FIGS. 11 and 12, but such drawings are utilized to better show the relationship between the holder and the upwardly cupped palm. In this use position, the holder assumes a position where the lower narrow base rests on the fleshy/muscular potion or pads at the upper portion of the cupped hand where the fingers join the palm and directly opposite the knuckles. In this position, the base acts as a platform that distributes the weight of the bags to the fleshy pad portion of the palm underlying and contacting the base lower surface. This evenly distributes and bears such weight without tending to bend or crease the base. In that position, the base evenly distributes the weight of the bags and maintains a firm platform underlying the base to bear such weight without bending or creasing.

Holders designed without a central base or one that is not adequately supported are prone to crease under weight. Such a crease line pinpoints the weight load, in turn, sharply pressing ("cutting") and painfully constricting the hand and fingers. Thus, the entire function of the holder would be largely negated.

The following describes how the central base functions to help prevent numbness to fingers and/or damage to the user's hands:

When the hand is cupped to carry bags or any object, the fleshy/muscular portion of the hand below the finger line is raised to increase the cushioning effect of that portion of the palm for carrying or holding.

Figure 12:
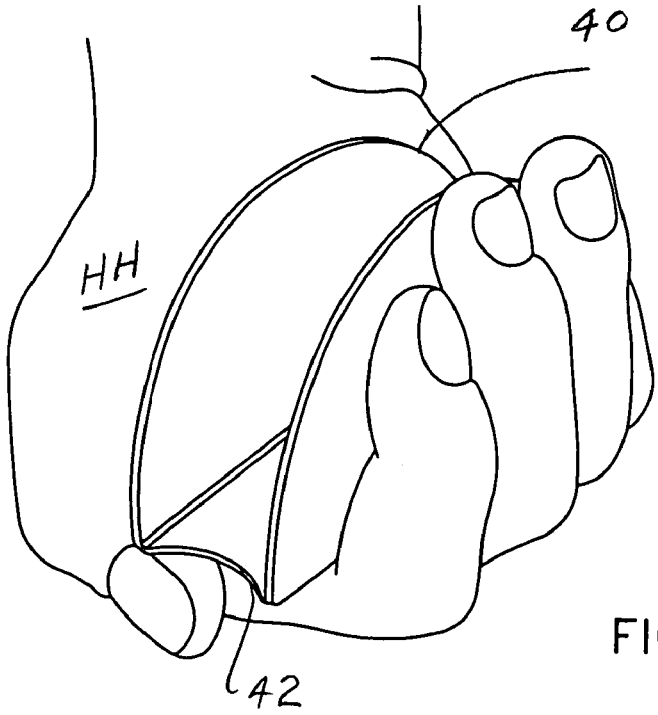
FIG. 12 is a perspective view showing the holding position of the holder with the fingers engaging the bottom surface of one of the sidewalls and the thumb extending downwardly for clarity.
Figure 13:
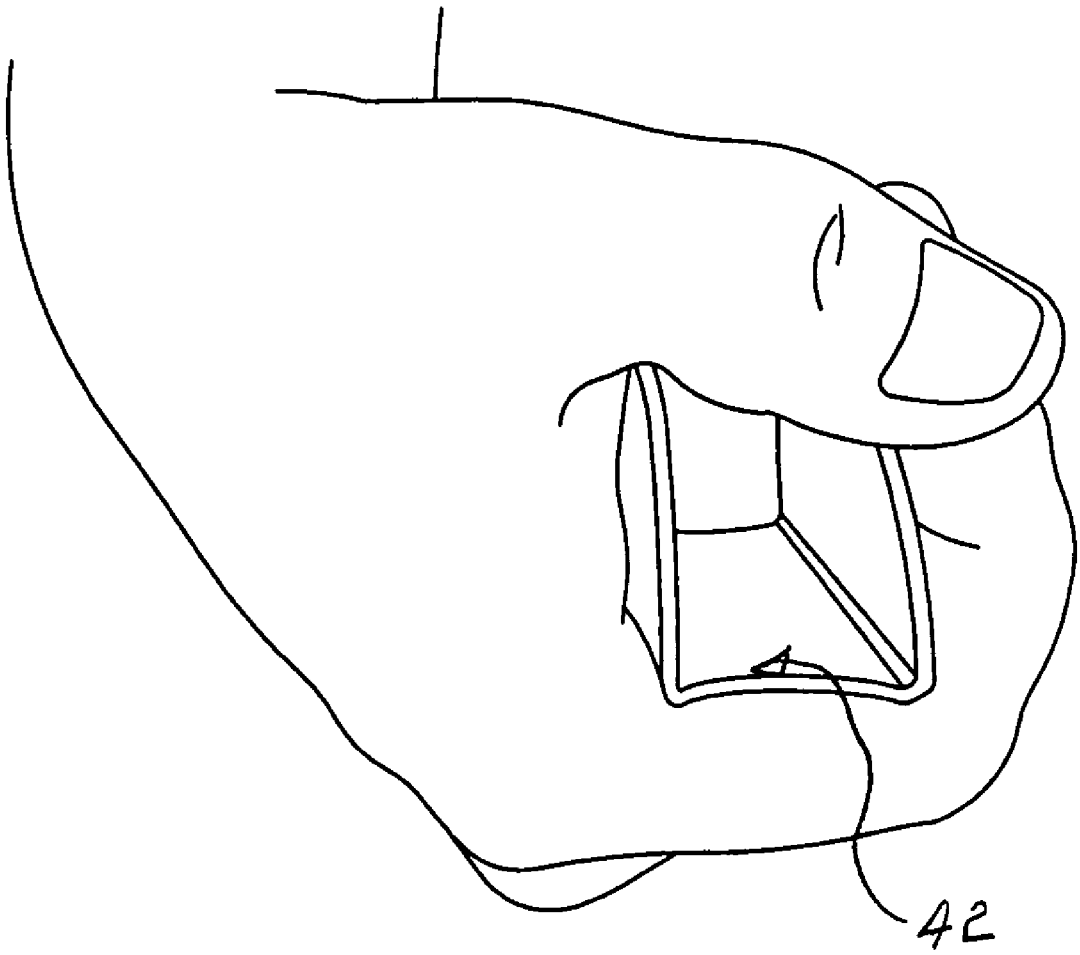
FIG. 13 is a perspective view showing the preferred holding position.
Figure 14:
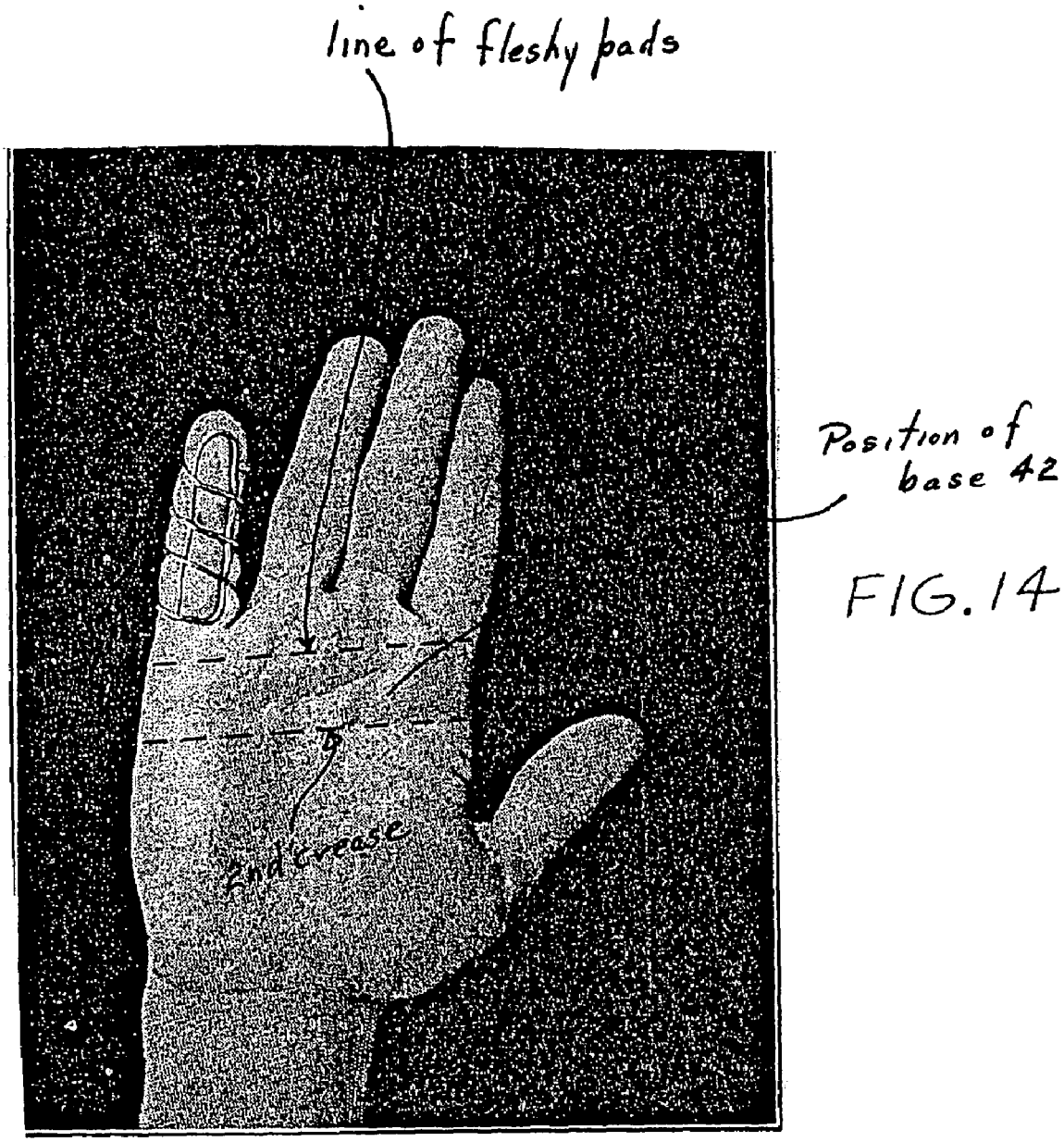
FIG. 14 is a plan view of a human palm showing the preferred placement of the holder base overlying the line of fleshy palm pads with its inner edge roughly in line with the second palm crease.

Taking advantage of this cushioned palm portion, the central base of the holder acts as a platform for bag handles. The base fits exactly on that cushioned portion of the hand, and the position of the base is further enhanced and secured by the hand's natural cupping position keeping the base snug between the fingers and upper palm Such positioning is further assumed in the desired hand to holder use position as shown in FIGS. 5 and 12 by the fingers pressing inwardly or resting against the outer surface of one of the sidewalls and the heel of the thumb similarly acting upon the outer surface of the other sidewall. As a result, the holder of the present invention fits securely in the natural cupping position of the hand while evenly distributing weight and effectively eliminating discomfort from the bag handles.

Figure 8:
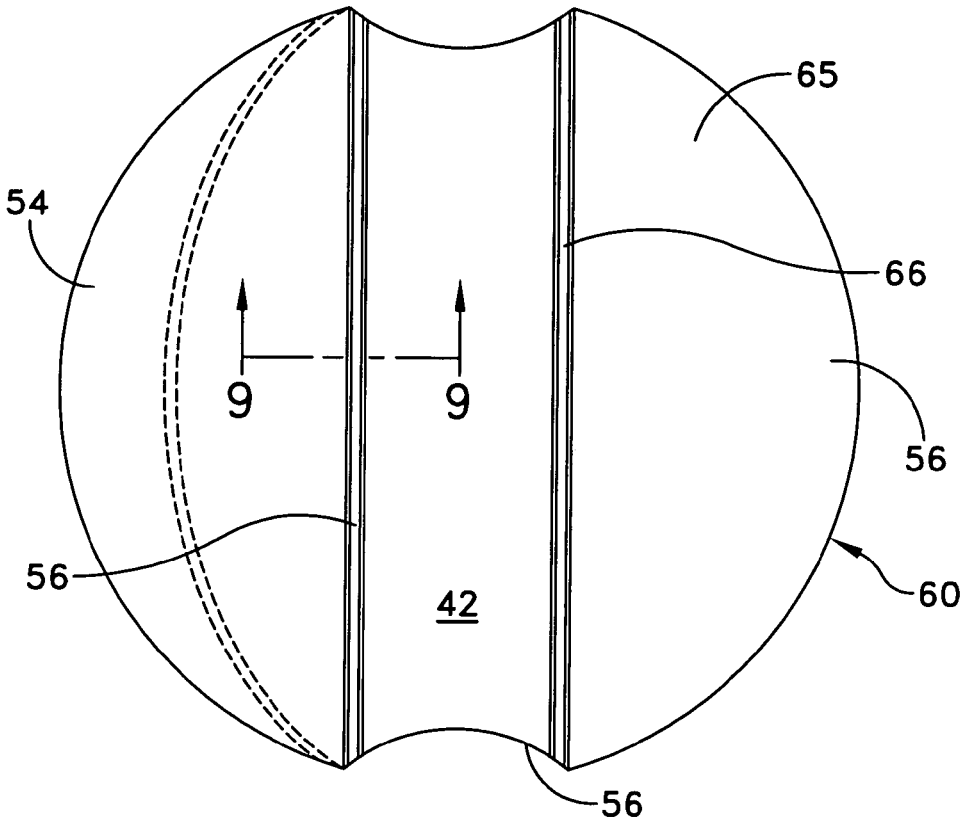
FIG. 8 is a top plan view of a blank from which the device of FIG. 6 is formed.
Figure 9:
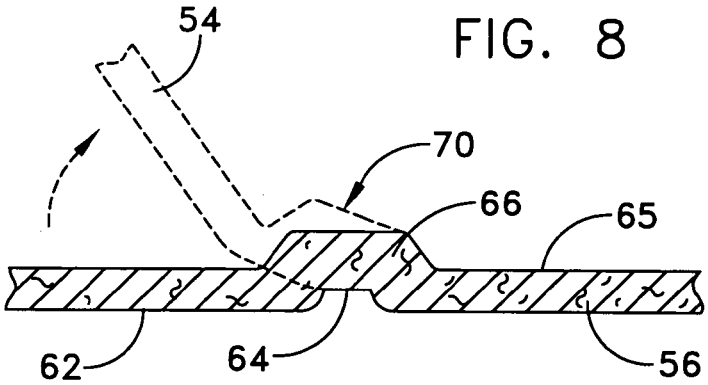
FIG. 9 is an enlarged sectional view along the line 9—9 of FIG. 8.
Figure 10:
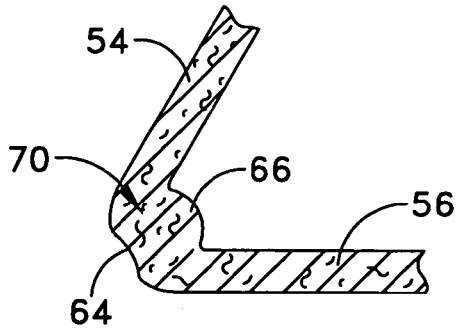
FIG. 10 is an enlarged sectional view along the line 10—10 of FIG. 6.

In addition, the bunched boss or material ridges 66 of migrated material formed along with the recesses 64 resist and provide tactile feedback so that upwardly over bending where the sidewalls are forcibly crushed against each other is avoided. Such action further avoids potential undesirable creasing of the base as does the positive definition of the base by such weakened lines or recesses 64, that is, the recesses preferably are chordal and extend side to side of the blank forming the holder as best shown in FIG. 8.

The lateral distance between the weakened lines or recess 64 is approximately one inch, which defines the lateral extent of the base 42. Although both surfaces of the blank may be left in their natural state, it is preferable as previously indicated that the lower surface 62 be provided with a coating that enables such surface to more readily accept printing and the like and thus the sheet from which the blanks are cut can then be preprinted such that advertising material, instructions and the like can be printed on either surface but preferably such that when the sidewalls 70, 72 are upwardly swung in the use position as shown in FIG. 5 that the indicia is displayed on either side thereof. Also, it is intended that the devices 40 be distributed in their flat unfolded state in the grocery store with surface 62 uppermost and visible to the customer. Of course, advertisement or other indicia can be provided as by printing, etc. on the upper surface 65 as well. The overall size and configuration of the device in its use position as shown in FIG. 5 is somewhat similar to the comfortable feel and use characteristics of the embodiment shown in FIGS. 1 and 4 and accomplishes these overall objectives in a far less expensive fashion.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described.

What is claimed is:

1. A holder for supporting the handles of plastic grocery bags in the palm of a human hand, said holder comprising a flat generally elongated base having laterally opposed side edges and opposed upper and lower flat surfaces, a pair of flat sidewalls having opposed outer and inner surfaces upstanding from and connected to the base side edges, said base of a lateral extent so as to enable said holder to be grasped by the cupped configuration of the palm of a human hand such that one base side edge is disposed along the fleshy pads where the fingers of a human hand connect to the palm thereof and the other base side edge is disposed along the palm crease located generally along the knuckle line of the human hand and wherein the outer surfaces of said sidewalls respectively contact the heel of the thumb and the inner surfaces of the fingers of a human hand and wherein upper surfaces of said base and said sidewalls form a recess for supporting the handles of plastic grocery bags, said base comprising, a flat member having a generally circular peripheral edge formed from thin stiff paperboard stock and having upper and lower opposed surfaces, a pair of laterally opposed generally parallel longitudinally extending chordal recesses die punch formed into the lower surface thereof to form weakened lines along said lower surface recesses and bunched material lines along those portions of the upper surface superposed with respect to said recesses, said recesses defining said flat generally elongated base and said pair of flat sidewalls on either side thereof such that the sidewalls may be upwardly rotated about said base to an upright position generally normal to said base wherein said base upper surface is disposed upwardly and said rotation facilitated by said weakened lines and simultaneously resisted by said bunched material lines such that the sidewalls resist flattening contact with each other so as to resist creasing and maintain the flat configuration of said base.

2. The holder set forth in claim 1 wherein said base includes opposed peripheral edge portions each inwardly arcuately shaped.

3. The holder set forth in claim 1, said base including opposed peripheral edge portions each inwardly arcuately-shaped cutouts, the handles of plastic grocery bags adapted to extend into said cutouts to resist slippage across said base peripheral edge portions when supported by the human hand as when the user carries groceries in said plastic bags.

4. The holder set forth in claim 1, said base being approximately 1 inch wide and said sidewalls upwardly extending approximately 1¾ inches in height in their normal angular disposition to said base.

* * * * *